United States Patent [19]

Katernberg

[11] 4,084,529

[45] Apr. 18, 1978

[54] FLOATING DRY DOCK WITH LIFTING PONTOONS

[75] Inventor: Helmut Katernberg, Oberhausen, Germany

[73] Assignee: Gutehoffnungshutte Sterkrade Aktiengesellschaft, Germany

[21] Appl. No.: 709,073

[22] Filed: Jul. 27, 1976

[30] Foreign Application Priority Data

Jul. 31, 1975 Germany ..... 2534171

[51] Int. Cl.[2] ..... B63C 1/02

[52] U.S. Cl. ..... 114/46; 114/45; 61/64; 114/267

[58] Field of Search ..... 114/45, 46, 47, 48, 114/49, 50, 51, 53; 61/64, 65

[56] References Cited

U.S. PATENT DOCUMENTS

| | | | |
|---|---|---|---|
| 857,733 | 6/1907 | Gunnell | 114/46 |
| 1,279,084 | 9/1918 | Crandall | 114/46 |
| 2,360,690 | 10/1944 | Koulichkov | 114/45 |
| 2,894,472 | 7/1959 | Foster | 114/45 |

FOREIGN PATENT DOCUMENTS

| | | | |
|---|---|---|---|
| 337,879 | 11/1903 | France. | |
| 30,694 of | 1898 | United Kingdom | 61/65 |

OTHER PUBLICATIONS

Die Vereinheitlichung der Schwimmdocks-Kurt Robser.

*Primary Examiner*—Trygve M. Blix
*Assistant Examiner*—D. W. Keen
*Attorney, Agent, or Firm*—McGlew and Tuttle

[57] ABSTRACT

A floating dry dock system comprises a main or central boxlike dry dock which for example may include a bottom and a side wall on each side and a lifting pontoon associated with the central unit which is adapted to be flooded so as to be positionable completely across the bottom of the central unit. The pontoon made of a size sufficient to permit it to be ballasted to raise the central unit above the level of the water so that the portions thereof which are not covered by a pontoon are freely accessible on their bottoms above the sea level. The pontoon advantageously includes at least one console on one side to accommodate the ballasting equipment and it has advantageously mated separable bottom box shaped tanks which are interconnected with a side tank having a console and upward extension.

3 Claims, 4 Drawing Figures

FLOATING DRY DOCK WITH LIFTING PONTOONS

BACKGROUND OF THE INVENTION

1. Field of the Invention

This invention relates in general to the construction of dry docks and in particular to a new and useful dry dock system or assembly which includes a main dry dock unit of a boxlike construction with one or more pontoons which may be positioned completely below the main dry dock to extend across the whole bottom and which may be ballasted to raise the main dry dock out of the water.

2. Description of the Prior Art

A known dry dock comprises a self docking floating dry dock which comprises a boxlike central or main unit with lifting pontoons which are engageable from below the unit along its entire cross sectional width and which in their lowered self buoyant position are freely displaceable along the central unit. In addition it is known to provide a dry dock which includes an internal subdivision of the lifting pontoon into two flat middle boxes and two L-shaped lateral boxes. In all of the prior art constructions of self docking pontoon docks, the individual pontoons are integrated with the whole structure of the dock with the result that weak points appear in the dock parts which may substantially affect the total strength of the structure. Longitudinal forces occurring during the docking or during the transport on the open sea can be absorbed in the zone of joints and gaps only by the lateral boxes between the pontoon deck and the upper deck which must be substantially reinforced for this purpose. To this end for example reinforcing frames must be provided in the lower chord if the individual pontoons are to be disengageable. In addition the marine insurance companies require a bridging of the gaps between the individual pontoons by means of expensive reinforcements during transportation of the docks on the high seas and these reinforcements must be removed again partly by underwater work after the arrival of the dock at the port of destination or prior to self docking. All docking equipment in every pontoon such as pump shafts, pipings, slide valves, drive shafts, etc. are to be made separable in a suitable manner in order to permit an individual docking of the pontoons.

Special measures must be provided for cross connection cables and supply lines. The connecting lines between the draining installations of the pontoons are to be laid in the lateral box of the central unit and must be equipped with vacuum pumps. The self docking proper is effected step by step. For this purpose the screw connections between the lateral box of the central unit and the pontoons are to be loosened. These operations are frequently difficult because the screw connections are often corroded by the sea water. Extensive repair times in such docks substantially reduce their rentability.

SUMMPARY OF THE INVENTION

In order to remedy the drawbacks of the prior art, the present invention is directed to a floating dry dock which comprises a self docking equipment which is simple in design and construction and uncomplicated and does not require excessive seamanship skill to use.

In accordance with the invention a floating dry dock is provided in which the deck of each lifting pontoon comprises drain shafts which are located close to the lateral, console like extension and serve for the purpose of accommodating transportable submergible pumps and in which the steel beams of the deck extend athwartships and are spaced from each other by the distances of the structural cross beams of the deck and provided with a wooden supporting surface.

Accordingly it is an object of the invention to provide a combination main dock and pontoon for raising the dock out of the water which includes a pontoon which extends across the width of the main dock and which carries steel beams on its deck which are spaced apart by distances corresponding to the spacing of the transverse beams of the main dock which are provided with wooden bearing surfaces for supporting the main dock.

A further object of the invention is to provide a dry dock which includes a main section and a lifting pontoon and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

GENERAL DESCRIPTION OF THE PREFERRED EMBODIMENT

Figure 1:
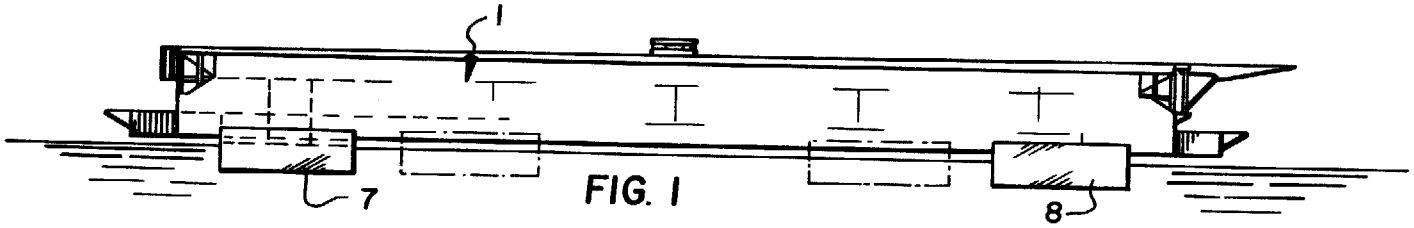
FIG. 1 is a lateral elevational view of a floating dry dock having associated smaller lifting pontoons constructed in accordance with the invention.

Referring to the drawings in particular, the invention embodied therein comprises a main or central dock unit generally designated 1 which has a carrying capacity of 20,000 metric tons. The dock comprises a central unit which is designed as a box dock and which includes bulkheads which are shown in dotted lines and which give the dock a satisfactory longitudinal and lateral strength. The central unit is not subdivided into individual parts which would be separable from each other as is provided in a so-called "Rennie Dock". The length of the dock is for example 200 meters from bow to stern.

Figure 3:
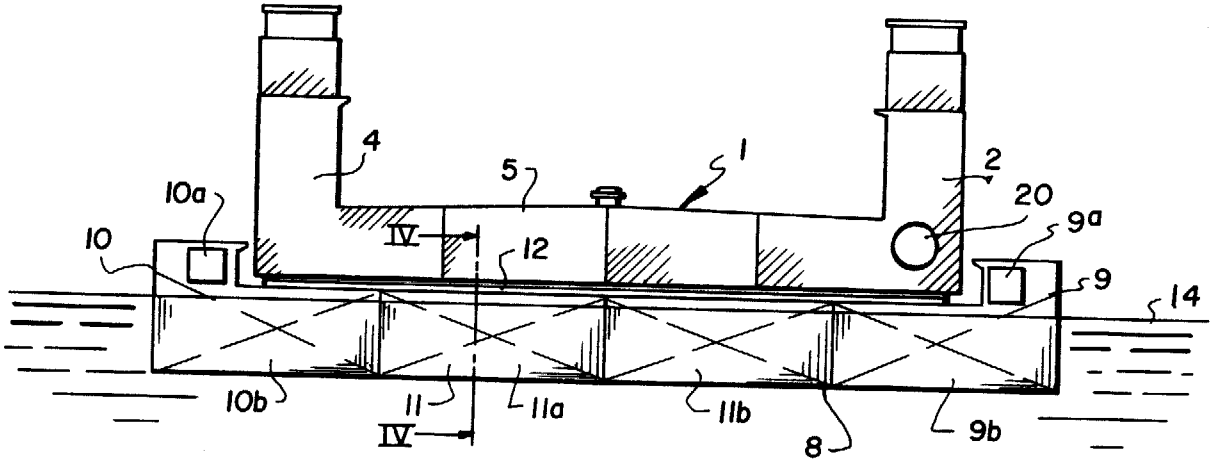
FIG. 3 is an enlarged sectional view taken along the line III—III of FIG. 2.
Figure 4:
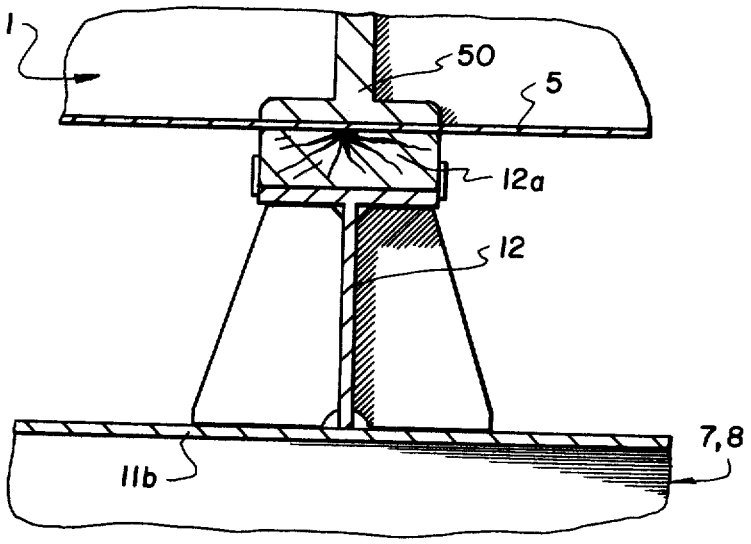
FIG. 4 is an enlarged sectional view taken along the line of IV—IV of FIG. 3.

As best seen in FIG. 3 the central unit 1 comprises two lateral walls 2 and 4 and a bottom 5 which results in approximately C-shaped cross section. The usual parts of equipment such as maintenance stations, cranes and the like are not shown.

The entire system includes the central unit and two lifting pontoons 7 and 8 which are of relatively small dimensions in respect to the central unit 1. In the example indicated the extension direction of the dock axis is approximately 22.5 meters. Lifting pontoons 7 and 8 are provided with lateral upwardly extending console-like extensions 9 and 10 at the respective side ends and they include a bottom part 11 of flat configuration which extends entirely across the width of the bottom of the main dock 1. In accordance with a feature of the invention the deck or top surface of the pontoons 7 and 8 are provided with upwardly extending steel beams 12 which are disposed on the deck and in spaced parallel relationship and covered with a wooden supporting surface. The steel beams 12 have an overall height of one half a meter and they are spaced from each other along the length of the deck by distances which correspond to the longitudinal spacing of transverse deck beams 50 along the bottom 5 of the central or main dock 1. The beams 12 are topped by wooden beams **12*a* which define a wooden bearing surface for the central dock unit 1**.

The console portion 9 and 10 advantageously carry ballasting equipment **9*a* and 10*a* which includes pumps and drains for effecting the filling of the entire pontoons 7 or 8 and the discharge or draining of the pontoons when they are to be floated upwardly to raise the dock. As a general matter the central portion of the pontoons 7 and 8** do not have any particular equipment for the docking other than water drain holes for the residual water which can not be pumped out.

Figure 2:
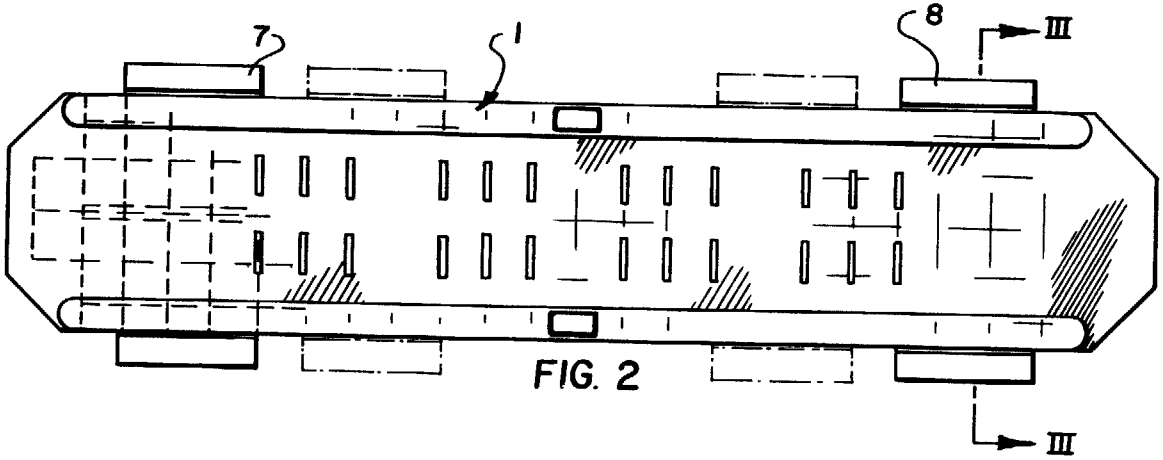
FIG. 2 is a top plan view of the dock shown in FIG. 1.

The operation of the device is as follows:

Lifting pontoons 7 and 8 are lowered after the central unit has been lifted upwardly in the water as far as possible by its own ballasting system which is indicated generally at 20 in FIG. 3. The pontoons 7 and 8 are provisionally fixed as shown in FIGS. 1 and 2 at the bow and at the stern by means of ropes or cables and are thereupon pumped out. Thereby because of their shape and their predetermined positive buoyancy a lifting force of approximately 5000 metric tons is produced by the ballasting equipment **9*a* or 10*a*. Since the entire dock structure weights approximately 7500 metric tons, the main dock 1 is lifted up to a level of about 1.2 meters above the water surface 14 as shown in FIG. 3. Consequently, the underside of the central unit 1 can be worked at all locations which are not covered by the pontoons 7 and 8. As soon as the central unit is lifted by means of the pontoons 7 and 8 so far that the keel surface comes to lie above the water surface, the water drain holes in the bottom of the central unit are open to drain off the residual water. With the work of the keel surface finished, the pontoons are flooded again and thereby lowered. Then they may be displaced relative to the central unit for example along the length thereof. Thereupon the central unit 1** is lifted again and this requires neither dismounting nor mounting work to be carried out on the dock itself.

In the time during which the lifting pontoons 7 and 8 are not needed for lifting the central unit 1 they may be used for other purposes in the harbor or docking routine. For example they may serve as transports, working, access pontoons, floating workshops, and for smaller docking work including the docking of launches and similar small boats.

As shown in FIG. 3 from the point of view of their cross-sectional configuration the pontoons 7 and 8 may be assembled from two flat middle boxes **11*a* and 11*b* and two L-shaped end boxes 10*b* and 9*b***.

While a specific embodiment of the invention has been shown and described in detail to illustrate the application of the principles of the invention, it will be understood that the invention may be embodied otherwise without departing from such principles.

What is claimed is:

1. A floating dry dock system comprising a central unit of a floodable and drainable box having lateral walls and a bottom with transverse beams extending thereacross at spaced longitudinal locations, at least one smaller lifting pontoon on which the central unit can be placed and which has a positive buoyancy dimensioned so that said central unit can be lifted from the water, with said central unit of the dock being designed as a box dock and said lifting pontoon being adapted to engage the dock from below along the entire corss-sectional width of said central unit and having a top deck, a plurality of steel beams on said top deck defining supporting surfaces for the docked central unit, said lifting pontoon having a lateral console-like extension at at least one side, pump and drain means for flooding and emptying said pontoon, said steel beams of the deck being arranged athwartships and spaced from each other by distances corresponding to the spacing of the transverse beams of the dock and are provided with a wooden bearing surface.

2. A floating dry dock according to claim 1, wherein said pontoons include a plurality of flat central boxes and an L-shaped box at each end of the central boxes which are interconnected.

3. A floating dry dock system, comprising a central longitudinally elongated dry dock, comprising a floatable and drainable box having lateral walls and a bottom with transverse beams extending across said bottom at spaced longitudinal locations, a plurality of smaller lifting pontoons located at spaced longitudinal locations along the length of said central dry dock, each having a central portion extending under said dry dock and a lateral portion on each side of said dry dock and each having ballastable tanks permitting it to be floated in place beneath said dry dock and to pumped out so as to provide a positive buoyancy below said dry dock sufficient to lift said dry dock out of the water, each pontoon having a bottom portion with a top deck having a plurality of steel beams thereon defining a supporting surface engagable with said central dry dock, said central dry dock having a plurality of longitudinally spaced transverse beams extending thereacross, said steel beams of said pontoon extending athwartships and spaced from each other in a longitudinal direction by distances corresponding to the spacing of said transverse beams of said dock and having a wooden bearing surface engageable against the bottom of said dry dock.

* * * * *